US009191733B2

(12) United States Patent
Yamada et al.

(10) Patent No.: US 9,191,733 B2
(45) Date of Patent: Nov. 17, 2015

(54) HEADPHONE APPARATUS AND SOUND REPRODUCTION METHOD FOR THE SAME

(75) Inventors: Yuuji Yamada, Tokyo (JP); Homare Kon, Tokyo (JP)

(73) Assignee: Sony Corporation, Tokyo (JP)

( * ) Notice: Subject to any disclaimer, the term of this patent is extended or adjusted under 35 U.S.C. 154(b) by 597 days.

(21) Appl. No.: 13/398,160

(22) Filed: Feb. 16, 2012

(65) Prior Publication Data

US 2012/0219165 A1 Aug. 30, 2012

(30) Foreign Application Priority Data

Feb. 25, 2011 (JP) ..... 2011-040964

(51) Int. Cl.

| | |
|---|---|
| ***H04S 7/00*** | (2006.01) |
| ***H04R 1/10*** | (2006.01) |
| ***H04R 1/40*** | (2006.01) |
| ***H04R 3/12*** | (2006.01) |

(52) U.S. Cl.

CPC ..... *H04R 1/1091* (2013.01); *H04R 1/40* (2013.01); *H04R 3/12* (2013.01); *H04R 2430/20* (2013.01); *H04S 7/30* (2013.01); *H04S 2400/11* (2013.01)

(58) Field of Classification Search

CPC . H04S 1/005; H04S 2420/01; H04S 2400/01; H04S 7/304; H04S 1/007; H04R 5/033; H04R 1/1041; H04R 2420/07; H04R 5/04; H04R 1/1016

USPC ..... 381/309, 310, 74, 77, 94, 97, 98, 371, 381/374

See application file for complete search history.

(56) References Cited

U.S. PATENT DOCUMENTS

| | | | | |
|---|---|---|---|---|
| 5,495,534 | A * | 2/1996 | Inanaga et al. | 381/310 |
| 5,526,429 | A * | 6/1996 | Inanaga et al. | 385/25 |
| 5,761,314 | A * | 6/1998 | Inanaga et al. | 381/17 |
| 6,021,205 | A * | 2/2000 | Yamada et al. | 381/310 |
| 6,532,291 | B1 * | 3/2003 | McGrath | 381/74 |
| 6,766,028 | B1 * | 7/2004 | Dickens | 381/310 |
| 7,289,641 | B2 * | 10/2007 | Yang | 381/382 |
| 7,684,577 | B2 * | 3/2010 | Arai et al. | 381/302 |
| 7,936,887 | B2 * | 5/2011 | Smyth | 381/74 |
| 8,130,988 | B2 * | 3/2012 | Sako et al. | 381/310 |
| 8,369,533 | B2 * | 2/2013 | Konagai et al. | 381/17 |
| 8,515,103 | B2 * | 8/2013 | Mei et al. | 381/309 |
| 2006/0045294 | A1 * | 3/2006 | Smyth | 381/309 |
| 2013/0216074 | A1 * | 8/2013 | Kon | 381/310 |

FOREIGN PATENT DOCUMENTS

| | | |
|---|---|---|
| JP | 3637596 | 1/2005 |

* cited by examiner

*Primary Examiner* — Vivian Chin
*Assistant Examiner* — David Ton
(74) *Attorney, Agent, or Firm* — Paratus Law Group, PLLC

(57) ABSTRACT

A headphone apparatus includes sound reproduction units which respectively reproduce sound signals and are arranged so as to be separated from ear auricles of a headphone user, wherein each of the sound reproduction unit is configured by a speaker array including a plurality of speakers.

13 Claims, 14 Drawing Sheets

HEADPHONE APPARATUS AND SOUND REPRODUCTION METHOD FOR THE SAME

BACKGROUND

The present disclosure relates to a headphone apparatus and a sound reproduction method for the headphone apparatus, and particularly to a headphone apparatus and the like which reproduces two-channel sound signals.

In the related art, there is a sound reproduction method according to which a headphone user (listener) wears a headphone on his/her head so as to cover both ears and listens to a sound signal (acoustic signal) from both ears. According to the sound reproduction method, a so-called lateralization phenomenon in which a reproduced sound image stays within the head of the listener even if a signal from the signal source is a stereo signal occurs.

On the other hand, there is a binaural collected sound reproduction method as a sound reproduction method by a headphone. The binaural collected sound reproduction scheme is a scheme as follows. That is, microphones called dummy-head microphones are provided for holes of both left and right ears of a dummy head on the assumption of the head of the headphone user. A sound signal from a signal source is collected by the dummy-head microphones.

If the headphone user actually wears the headphone and reproduces the thus collected sound signal, the headphone user can feel as if the headphone user were listening to the sound directly from the signal source. According to such a binaural collected sound reproduction method, it is possible to enhance a sense of direction, a sense of orientation, a sense of presence, and the like. However, it is necessary to prepare a signal source as a special source, which is different from a source for speaker reproduction, which collects sound source signals with a dummy-head microphone, in order to perform such a binaural collected sound reproduction method.

Thus, it can be considered that a reproduction effect that typical two-channel sound signals (stereo signals), for example, are used so as to be oriented outside a head (speaker positions) in the same manner as in speaker reproduction is obtained by applying the aforementioned binaural collected sound reproduction method by the headphone. In order to obtain sound image orientation outside a head with the use of a headphone, radiation impedance from entrances of external auditory canals of a headphone user to the outside becomes different from that in a case of a headphone non-wearing state.

That is, sound waves from the headphone repeats complicated reflection between ear auricles and headphone sound generating units and are transmitted from the entrances of external auditory canals to drum membranes. For this reason, even if it is attempted to transmit an optimal property to the entrances of external auditory canals or surfaces of the drum membranes, the reflection disturbs the property. Therefore, there is a disadvantage in that it is difficult to stably obtain a satisfactory sound image orientation.

For example, according to a headphone reproduction method described in Japanese Patent No. 3637596, a sound image orientation is enhanced by allowing radiation impedance from entrances of auditory canals to the outside to be close to that in the non-wearing state. That is, Japanese Patent No. 3637596 discloses that headphone sound generating units are positioned so as to be separate from ear auricles of a headphone user.

SUMMARY

According to the headphone reproduction method disclosed in Japanese Patent No. 3637596, it is possible to allow the radiation impedance from entrances of external auditory canals to the outside to be close to that in the non-wearing state and thereby to enhance a sound image orientation. However, sound waves radiated from the headphone sound generating units becomes spherical waves generated from the sound generating unit as a sound source and are transmitted while spreading. Therefore, there is a disadvantage in that influences of reflection and refraction in the ear auricles remain until the sound waves reach the entrances of external auditory canals or drum membranes, which change the property.

It is desirable to provide a satisfactory headphone apparatus which reproduces sound signals.

According to an embodiment of the present disclosure, there is provided a headphone apparatus including: sound reproduction units which respectively reproduce sound signals and are arranged so as to be separated from ear auricles of a headphone user, wherein each of the sound reproduction units is configured by a speaker array including a plurality of speakers.

According to the embodiment, the headphone apparatus is provided with sound reproduction units which respectively reproduce sound signals. Each of the sound reproduction units is arranged so as to be separated from an ear auricle of the headphone user and configured by a speaker array including a plurality of speakers. By configuring each sound reproduction unit by a speaker array as described above, it is possible to satisfactorily reproduce sound signals.

According to the embodiment, a sound signal output from each speaker of the speaker array may be configured such that sound formed by the sound signal is focused at a predetermined position. That is, a virtual sound source in which sound pressure is high is created at the predetermined position. For example, the focusing may be performed by adding a time difference and/or a level difference to the sound signal output from each speaker of the speaker array. In addition, the focusing is performed by arranging each speaker of the speaker array on a curved surface so as to surround an ear auricle of the headphone user. In such a case, it is possible to achieve various effects in accordance with the positions of the focusing.

For example, the focusing may be positioned at an entrance of an external auditory canal of the headphone user. In such a case, the virtual sound source is synthesized at the entrance of the external auditory canal of the headphone user. Since the virtual sound source is an intangible sound source, radiation impedance from the entrance of the external auditory canal of the headphone user to the outside becomes close to that in the non-wearing state, and therefore, it becomes possible to reduce disruptions in a property due to reflection in the speaker array. Accordingly, the acoustic property is less influenced by the ear auricle, and it becomes possible to provide a stable acoustic property in which influences of variations due to individual differences are reduced.

In addition, the focusing may be positioned between the speaker array and the entrance of the external auditory canal of the headphone user. In such a case, the virtual sound source is synthesized between the speaker array and the entrance of the external auditory canal of the headphone user. By synthesizing the virtual sound source at such a position, there is no tangible sound generating unit in the vicinity of the ear auricle, no reflection occurs in the sound generating unit, and it becomes possible to obtain a stable property. Moreover, it is possible to enhance a front orientation of a sound image with the use of an ear auricle property of the headphone user himself/herself.

In addition, the focusing may be positioned behind the speaker array. In such a case, the virtual sound source is synthesized behind the speaker array. By synthesizing the virtual sound source at such a position, it is possible to enhance a sense of distance in a sound image orientation.

According to the embodiment, the sound signal output from each speaker of the speaker array may be configured such that the sound formed by the sound signal becomes a planar wave. In such a case, it is possible to allow states of reflection and refraction in the ear auricle of the headphone user to be close to those in reproduction by placing the speaker away from the headphone user and thereby realizing a natural sound image orientation.

According to the embodiment, the headphone apparatus may further include a head motion detecting unit which detects a state of a head of the headphone user, and an orientation of a sound image formed by the sound signal is controlled based on the state of the head of the headphone user, which has been detected by the head motion detecting unit. For example, the position of focusing is changed based on the state of the head of the headphone user. In such a case, it is possible to correct a sound image orientation position so as not to be deviated even when the head of the headphone user moves, and it is possible to allow a sound image position to be coincident with a moving image position, for example.

According to the embodiment, each sound reproduction unit may be arranged in front of or behind the ear auricle of the headphone user, for example. In such a case, a sound generating surface of the speaker array is arranged so as to have a predetermined angle with respect to a surface facing the ear auricle of the headphone user. In so doing, it is possible to reduce the disruptions in a property due to reflection in the speaker array even when each sound reproduction unit is arranged in front of the ear auricle of the headphone user, for example.

According to the present technique it is possible to provide a satisfactory headphone apparatus which reproduces sound signals.

DETAILED DESCRIPTION OF EMBODIMENTS

Hereinafter, description will be given of embodiments of the present disclosure. In addition, the description will be given in the following order.

1. First embodiment
2. Second embodiment
3. Third embodiment

1. First Embodiment

Configuration Example of Stereo Headphone System

Figure 1:
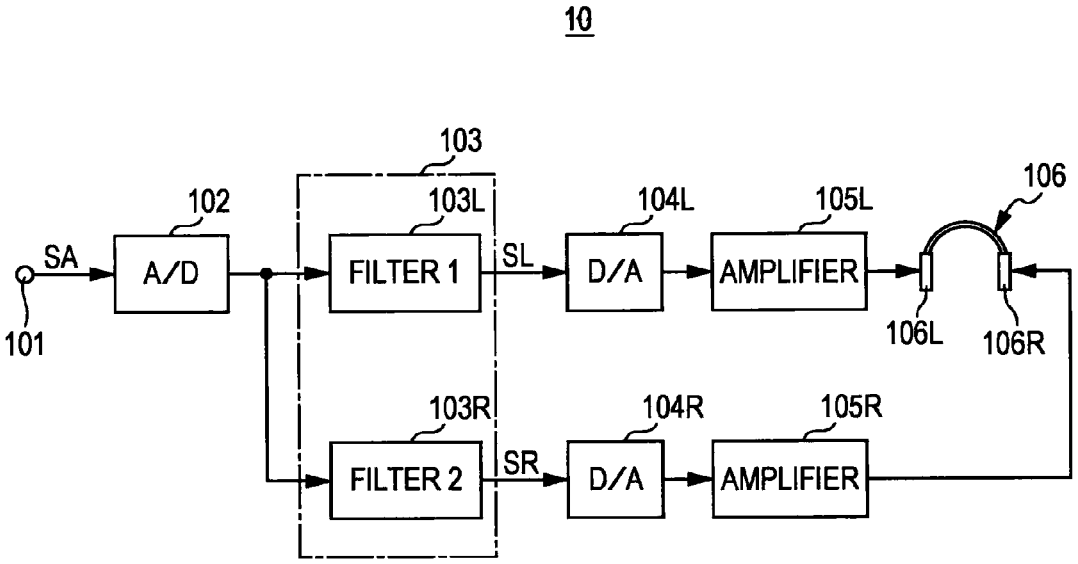
FIG. 1 is a block diagram showing a configuration example of a stereo headphone system according to a first embodiment of the present disclosure.

FIG. 1 shows a configuration example of a stereo headphone system 10 according to a first embodiment. The stereo headphone system 10 is provided with an input terminal 101, an A/D converter 102, a signal processing unit 103, D/A converters 104L and 104R, amplifiers 105L and 105R, and a headphone unit 106.

The input terminal 101 is a terminal to which a sound signal SA is input. The A/D converter 102 converts the sound signal SA input to the input terminal 101 from an analog signal to a digital signal. The signal processing unit 103 performs filtering to obtain a left channel sound signal SL and a right channel sound signal SR from the sound signal SA. That is, the signal processing unit 103 includes a filter (filter 1) 103L which is for obtaining the left channel sound signal SL from the sound signal SA and a filter (filter 2) 103R which is for obtaining the right channel sound signal SR from the sound signal SA. Here, the sound signals SL and SR configure two-channel sound signals.

Figure 2:
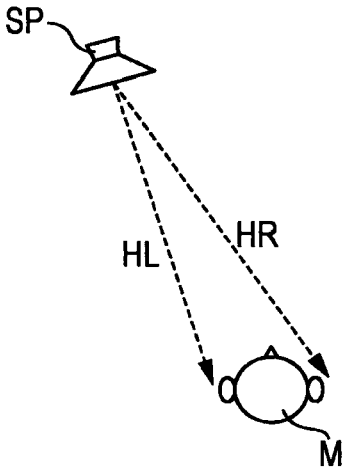
FIG. 2 is a diagram showing a state in which sound is propagated by speaker reproduction.

FIG. 2 shows a state in which sound is propagated by speaker reproduction. The sound reproduced by a speaker SP has a property to which reflection and refraction in ears of a listener M and reflection in a room and the like are added. The sound reproduced by the speaker SP reaches both ears of the listener M after a transmission property HL to the left ear and a transmission property HR to the right ear are respectively added thereto. The filter 103L is a filter with the transmission property HL from a sound source (speaker SP) located at a position where it is desired to orient a sound image to the left ear of the listener M. In addition, the filter 103R is a filter with the transmission property HR from the sound source (speaker SP) located at a position where it is desired to orient a sound image to the right ear of the listener M.

Figure 3:
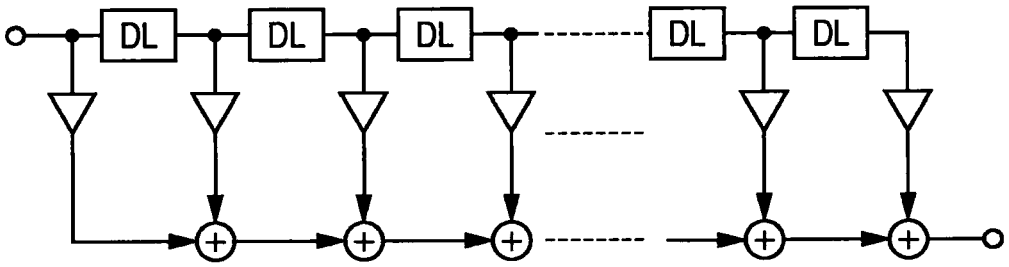
FIG. 3 is a diagram showing an FIR filter as an example of a digital filter included in a stereo headphone system.

It is possible to allow sound equivalent to sound reproduced by the speaker to propagate to both ears of the listener M even when the listener M listens to the sound with the use of the headphone, by obtaining the sound signals SL and SR by the filters 103L and 103R in the signal processing unit 103. That is, the listener M can listen to oriented sound even with the headphone as if the speaker SP generated the sound. The filters 103L and 103R are configured by FIR (Finite Impulse Response) filters as shown in FIG. 3, for example. The transmission properties HL and HR are measured with impulse response data, for example, and the measurement data is realized with the FIR filters.

The D/A converters 104L and 104R converts the sound signals SL and SR obtained by the signal processing unit 103 from a digital signal to an analog signal. The amplifiers 105L and 105R amplify the analog sound signals SL and SR converted by the D/A converters 104L and 104R and supply the amplified sound signals SL and SR to the sound reproduction units (speaker arrays) 106L and 106R for the left and right channels in the headphone unit 106.

Figure 4:
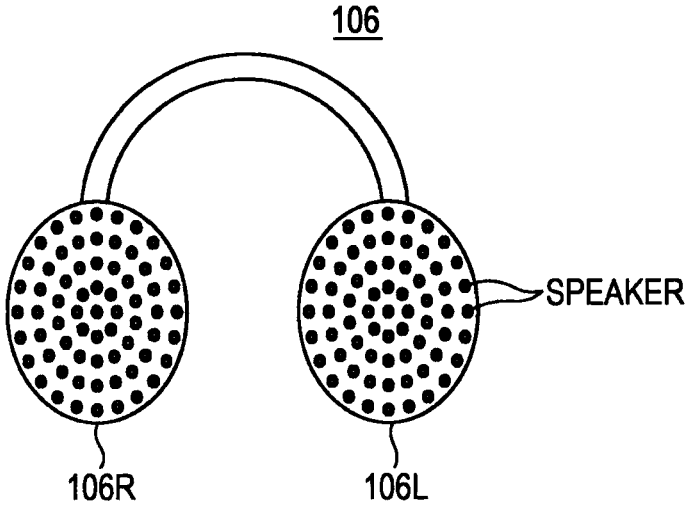
FIG. 4 is a diagram illustrating that sound reproduction units for left and right channels in a headphone unit are configured by speaker arrays including a plurality of speakers arranged in array shapes.
Figure 5:
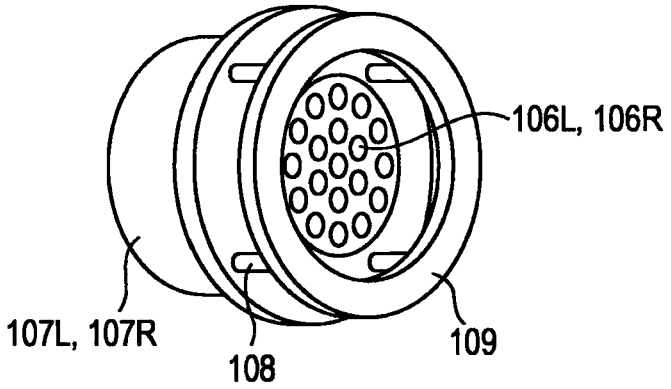
FIG. 5 is a diagram illustrating an example of a configuration in which a headphone unit is arranged so as not to be in contact with ear auricles of a headphone user (listener)

The sound reproduction units 106L and 106R for the left and right channels in the headphone unit 106 are configured by speaker arrays including a plurality of speakers arranged in array shapes as shown in FIG. 4. Each of the sound reproduction units 106L and 106R has a structure as shown in FIG. 5. That is, each of the sound reproduction units 106L and 106R has a structure arranged so as not to be in contact with an ear auricle of the user (listener) of the headphone unit 106, that is, so as to be separated from the ear auricle.

As shown in the drawing, contact units 109 are provided so as to protrude via supporting pillars 108 inside the headphone units 107L and 107R with the sound reproduction units (speaker arrays) 106L and 106R disposed in front thereof. The contact units 109 are formed to torus shapes and have a configuration in which ear auricles of the headphone user are inserted into hollow parts of the contact units 109.

Figure 6:
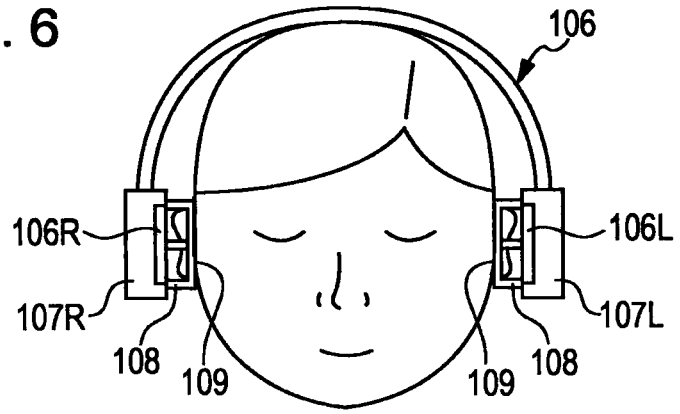
FIG. 6 is a diagram showing a state in which a headphone user wears a headphone unit on his/her head.

FIG. 6 shows a state in which the headphone user (listener) wears the headphone unit 106 on his/her head. In such a case, the aforementioned contact units 109 are pressed onto side parts of a face of the headphone user, and the sound reproduction units (speaker arrays) 106L and 106R are brought to be in a state in which the sound reproduction units (speaker arrays) 106L and 106R are separated from the ear auricles of the headphone user by predetermined distances.

Figure 7:
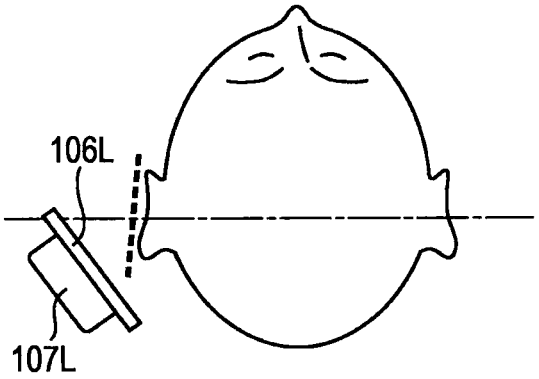
FIG. 7 is a diagram illustrating that sound reproduction units (speaker arrays) in a headphone unit are arranged behind ear auricles of a headphone user.
Figure 8:
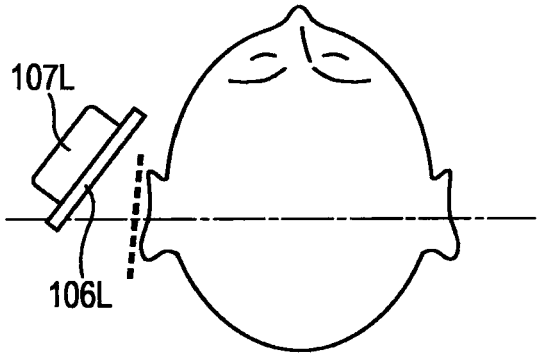
FIG. 8 is a diagram illustrating that sound reproduction units (speaker arrays) in a headphone unit are arranged in front of ear auricles of a headphone user.

FIGS. 7 and 8 schematically shows arrangement examples of the sound reproduction units (speaker arrays) in a state in which the headphone user wears the headphone unit 106 on his/her head as described above when viewed from an upper direction of the head. Although only the sound reproduction unit 106L is shown in FIGS. 7 and 8 for simplification of the drawings, the same is true for the sound reproduction unit 106R.

In the example of FIG. 7, the sound reproduction unit 106L is arranged behind the ear auricle of the headphone user. In the example of FIG. 8, the sound reproduction unit 106L is arranged in front of the ear auricle of the headphone user. Both arrangement positions are available for the sound reproduction unit. In such cases, a sound generating surface of the sound reproduction unit 106L is not parallel to a surface facing to the ear auricle of the headphone user, for example, a surface shown by a broken line in the drawing, and has a predetermined angle. With such a configuration, it is possible to reduce disruptions in the property due to the reflection in the sound reproduction unit 106L.

According to this embodiment, the sound signal output from each speaker of the sound reproduction units (speaker arrays) 106L and 106R is configured such that the sound formed by the sound signal is focused at a predetermined position. In such a case, a virtual sound source in which sound pressure is high is created at the predetermined position. Alternatively, the sound signal output from each speaker of the sound reproduction units (speaker arrays) 106L and 106R is configured such that the sound formed by the sound signal becomes a planar wave in this embodiment.

Figure 9A:
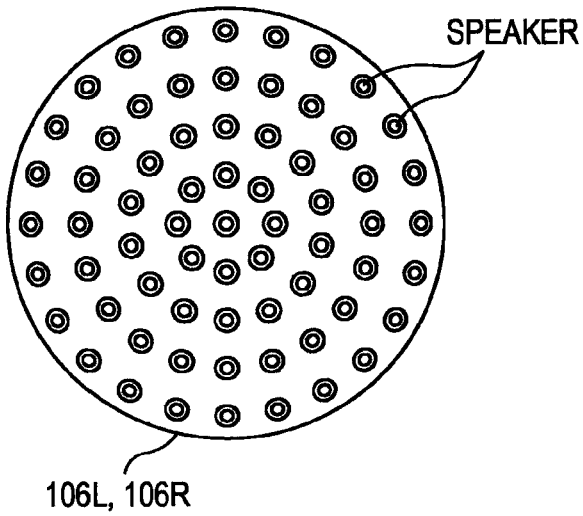
FIGS. 9A and 9B are diagrams showing a configuration example in which sound formed by sound signals output from each speaker of a sound reproduction unit (speaker array) is focused at a predetermined position.
Figure 9B:
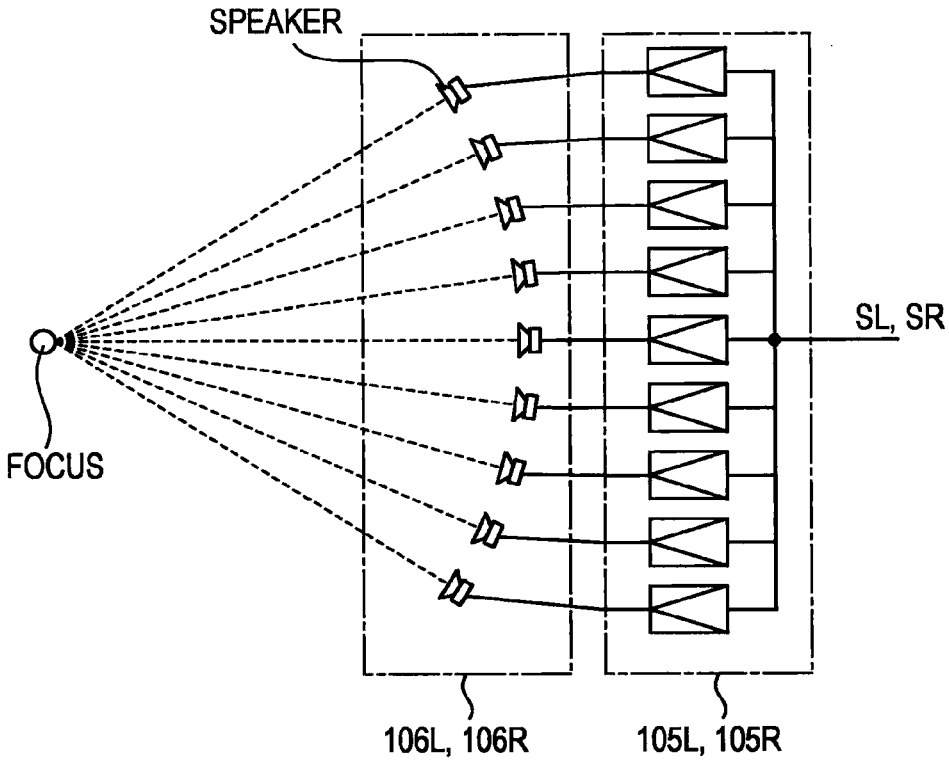

FIG. 9 shows a configuration example in which the sound formed by the sound signal output from each speaker of the sound reproduction units (speaker arrays) 106L and 106R is focused at a predetermined position. In this configuration example, as shown in FIG. 9B, each speaker (speaker unit) configuring the sound reproduction unit (speaker array) is arranged on a curve surface so as to be focused at a point which is separated from each speaker by the same distances, namely a focus position. In such a case, it is not necessary to individually set delay time and a level for each speaker, and it is possible to realize digital signal processing by one D/A converter for each channel output and one amplifier or reduce the number thereof with respect to the number of the speakers.

In such a case, each speaker is arranged on a curve surface so as to surround the ear auricle of the headphone user when the headphone user wears the headphone unit 106 as described above. FIG. 9A is a diagram of the sound reproduction units (speaker arrays) 106L and 106R when viewed from the front side. As shown in FIG. 9B, each of the sound signals SL and SR is supplied to each speaker configuring the sound reproduction units 106L and 106R via the amplifiers 105L and 105R.

Figure 10A:
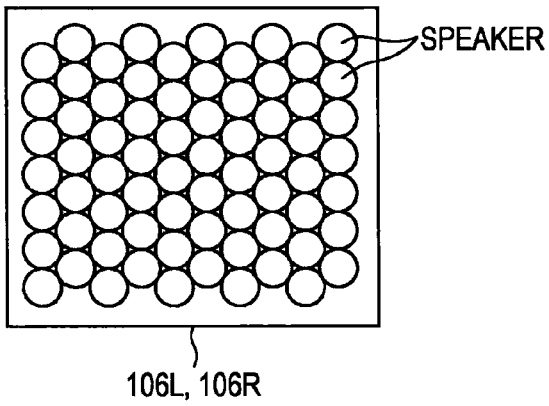
FIGS. 10A and 10B are diagrams showing another configuration example in which sound formed by sound signals output from each speaker of a sound reproduction unit (speaker array) is focused at a predetermined position.
Figure 10B:
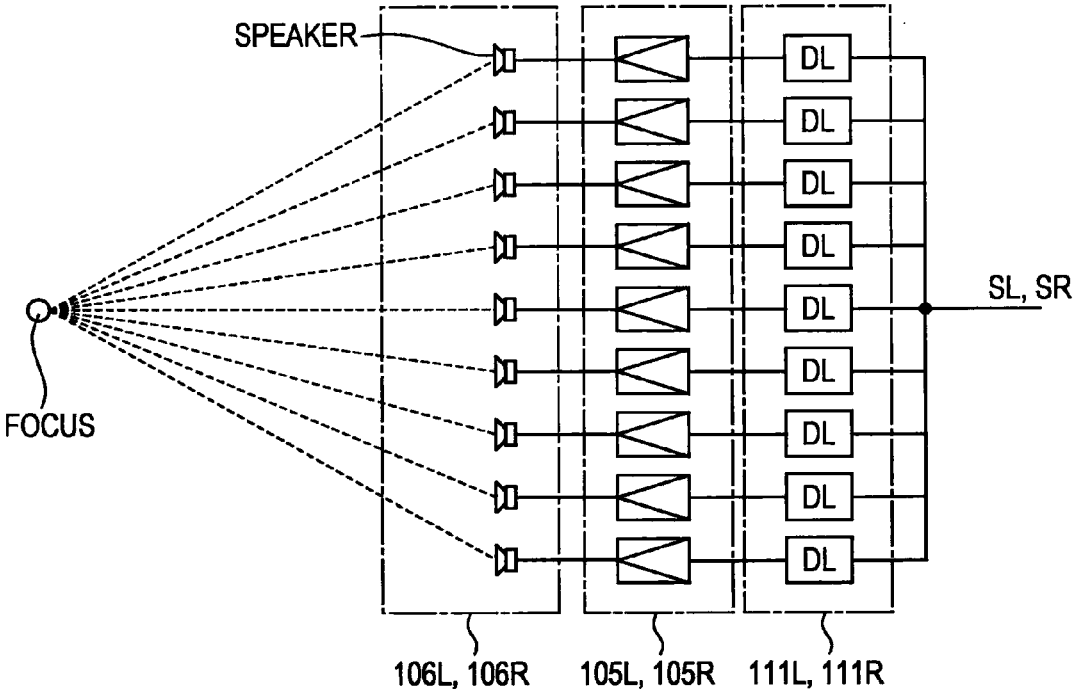

FIGS. 10A and 10B show another configuration example in which the sound formed by the sound signal output from each speaker of the sound reproduction units (speaker arrays) 106L and 106R is focused at a predetermined position. In addition, FIGS. 10A and 10B also show a configuration example in which the sound formed by the sound signal output from each speaker of the sound reproduction units (speaker arrays) 106L and 106R is allowed to be a planar wave. In this configuration example, each speaker (speaker unit) configuring the sound reproduction unit (speaker array) is arranged on a plane as shown in FIG. 10B. FIG. 10A is a diagram of the sound reproduction units (speaker arrays) 106L and 106R when viewed from the front side. FIG. 10A is a diagram of the sound reproduction units (speaker arrays) 106L and 106R when viewed from the front side. Since it is possible to arrange each speaker on a plane in this case, the structure of the speaker array becomes simple. In addition, it is also possible to freely set a position of a synthesized virtual sound source.

As shown in FIG. 10B, each of the sound signals SL and SR is supplied to each speaker configuring the sound reproduction units 106L and 106R via series circuits including the delay devices 111L and 111R and the amplifiers 105L and 105R. Although the delay devices 111L and 111R in FIG. 10B are not shown in FIG. 1, the delay devices 111L and 111R are inserted between the D/A converters 104L and 104R and the amplifiers 105L and 105R, for example. In the configuration example shown in FIGS. 10A and 10B, it is possible to allow the sound formed by the sound signal output from each speaker to be focused at a predetermined position by adding a time difference and/or a level difference to the sound signal output from each speaker by the delay devices and the amplifiers.

In FIG. 10B, the time difference and/or the level difference are added to the sound signal output from each speaker by the delay devices 111L and 111R and the amplifiers 105L and 105R after the sound signals SL and SR are converted into analog signals. However, a configuration can also be considered in which the time difference and/or the level difference are added to the sound signal output from each speaker by the delay devices and the level adjusters in a stage in which the sound signals SL and SR are digital signals.

Figure 11:
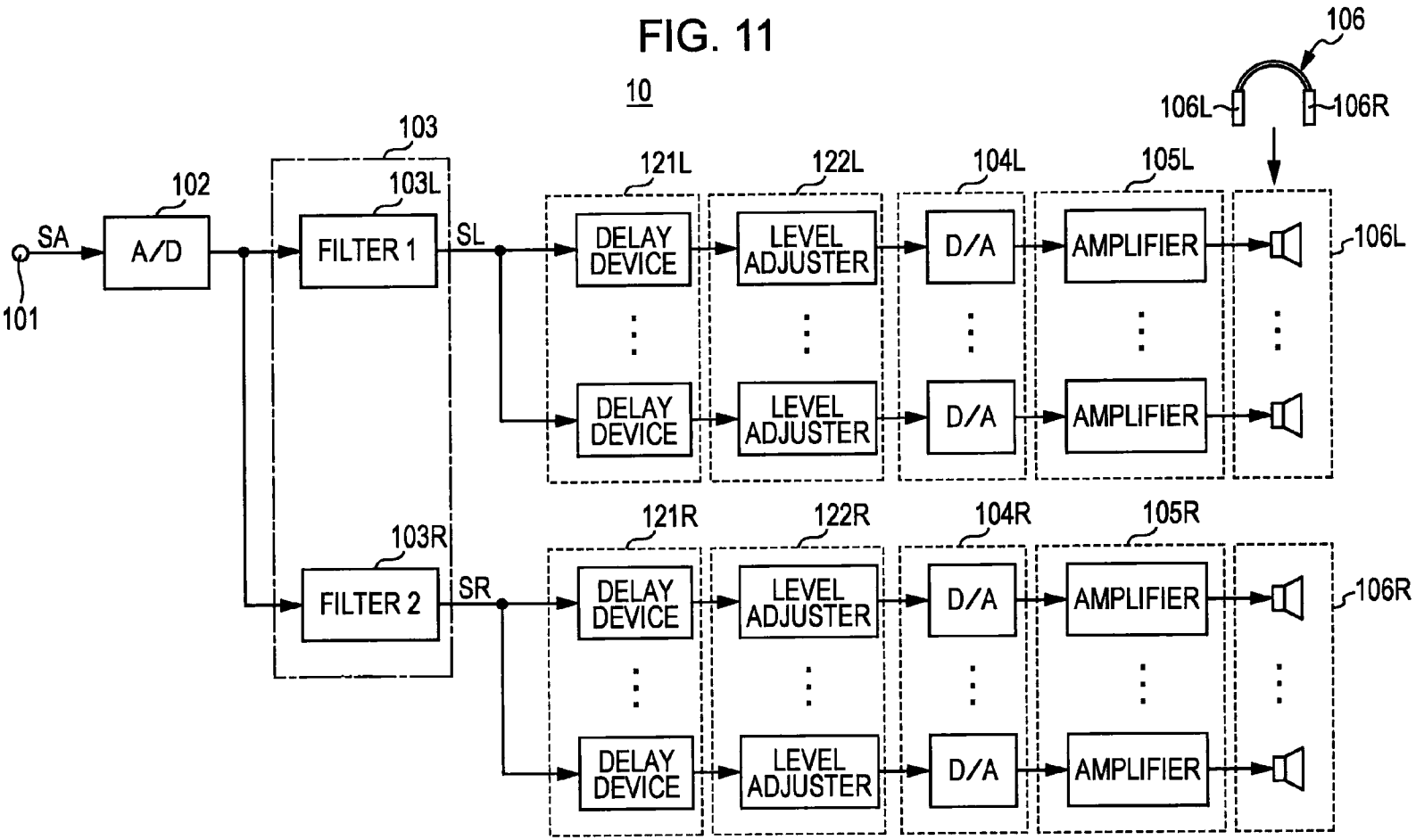
FIG. 11 is a block diagram showing a configuration example of a stereo headphone system when a time difference and/or a level difference are added to a sound signal output from each speaker by a delay device and a level adjuster in a stage in which sound signals SL and SR are digital signals.

FIG. 11 shows a configuration example of the stereo headphone system 10 in such a case. In this case, delay devices 121L and 121R and level adjusters 122L and 122R are inserted between the filters 103L and 103R and the D/A converters 104L and 104R. In addition, the order of the delay devices 121L and 121R and the level adjusters 122L and 122R may be opposite.

In such a case, the focusing can be positioned both in front of and behind the sound generating surfaces of the sound reproduction units (speaker arrays) 106L and 106R. For example, it is possible to position the focusing in front of the sound generating surfaces of the sound reproduction units (speaker arrays) 106L and 106R and synthesize the virtual sound source at the positions, by adding the time difference and the level difference such that the delay time becomes longer while the level becomes lower from a peripheral part to a center. On the other hand, it is possible to position the focusing behind the sound generating surfaces of the sound reproduction units (speaker arrays) 106L and 106R and synthesize the virtual sound source at the positions, by adding the time difference and the level difference such that the delay time becomes longer while the level becomes smaller from the center to the peripheral part.

In the configuration example shown in FIGS. 10A and 10B, it is possible to allow the sound formed by the sound signal output from each speaker to be a planar wave if the time difference and/or the level difference are not added to the sound signal output from each speaker by the delay devices and the amplifiers. In such a case, the delay devices 111L and 111R are not necessary.

Next, description will be given of the operation of the stereo headphone system 10 shown in FIG. 1. The sound signal SA is input to the input terminal 101. The sound signal SA is input to the signal processing unit 103 after the sound signal SA is converted from an analog signal to a digital signal by the A/D converter 102. The signal processing unit 103 performs filtering on the sound signal SA with the filter (filter 1) 103L to obtain a left channel sound signal SL. In addition, the signal processing unit 103 performs filtering on the sound signal SA with the filter (filter 2) 103R to obtain a right channel sound signal SR.

Each of the sound signals SL and SR obtained by the signal processing unit 103 is converted from a digital signal to an analog signal by the D/A converters 104L and 104R, respectively. Then, the sound signals SL and SR are supplied to the sound reproduction units (speaker arrays) 106L and 106R for both channels in the headphone unit 106 after being amplified by the amplifiers 105L and 105R. Then, each speaker of the speaker arrays configuring the sound reproduction units 106L and 106R is driven by the sound signals SL and SR.

In such a case, the sound formed by the sound signal output from each speaker of the sound reproduction units (speaker arrays) 106L and 106R is focused at a predetermined position, and the virtual sound source is synthesized at the predetermined position, for example. Alternatively, the sound formed by the sound signal output from each speaker of the sound reproduction units (speaker arrays) 106L and 106R is allowed to be a planar wave in this case, for example.

[States of Focusing and Planar Wave]

First, description will be given of a case in which the sound formed by the sound signal output from each speaker of the sound reproduction units (speaker arrays) 106L and 106R is focused at a predetermined position and the position corresponds to one of the following (1) to (3).

(1) "Entrance of External Auditory Canal of Headphone User (Listener)"

Figure 12:
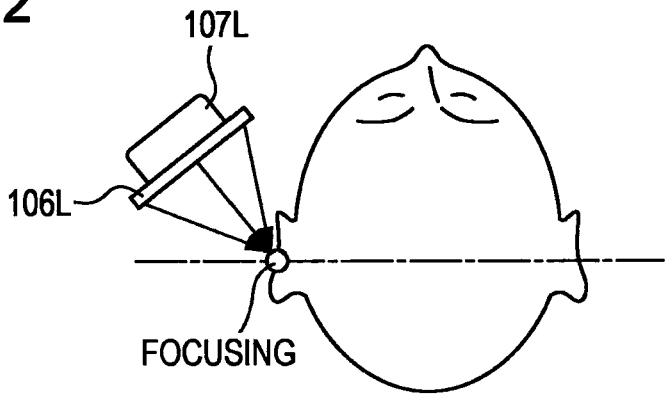
FIG. 12 is a diagram illustrating that focusing of sound which is formed by a sound signal output from each speaker of a sound reproducing unit (speaker array) can be positioned at an entrance of an external auditory canal of a headphone user (listener)
Figure 13:
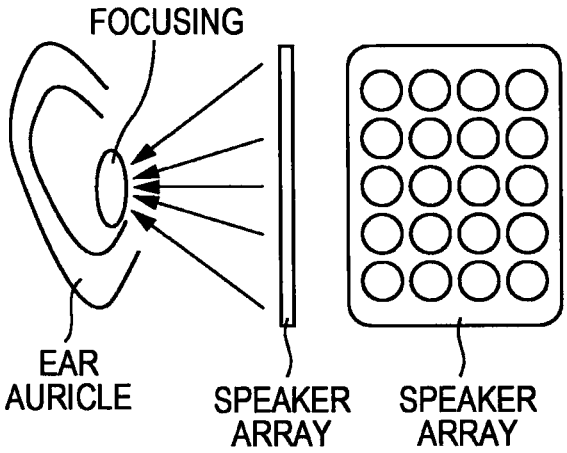
FIG. 13 is a diagram showing an example in which focusing of sound to an entrance of an external auditory canal is realized with a speaker array in which each speaker is arranged on a plane.

The focusing of the sound formed by the sound signal output from each speaker of the sound reproduction units (speaker arrays) 106L and 106R can be positioned at the entrance of the external auditory canal of the headphone user (listener) as shown in FIG. 12. The entrance of the external auditory canal described herein includes the vicinity of the entrance of the external auditory canal. FIG. 13 shows an example in which the focusing of the sound at the entrance of the external auditory canal is realized by the speaker array in which each speaker is arranged on a plane.

In such a case, the virtual sound source is synthesized at the entrance of the external auditory canal. The sound source is not a substantial sound source. Therefore, radiation impedance from the entrance of the external auditory canal to the outside becomes close to that in the non-wearing state, and it is possible to reduce disruptions in the property due to reflection in the speaker array as the sound generating unit. Therefore, an acoustic property is less influenced by the ear auricle in this case, and it is possible to reduce the influence by variations due to individual differences and thereby to provide a stable acoustic property to the headphone user. In addition, it is possible to reduce attenuation in energy propagation by creating a virtual sound source, in which sound pressure becomes higher, between the ear auricle and a real speaker and thereby to secure sufficient volume even if the real sound generation unit is away from the entrance of the external auditory canal.

(2) "Position Between Speaker Array and Entrance of External Auditory Canal"

Figure 14:
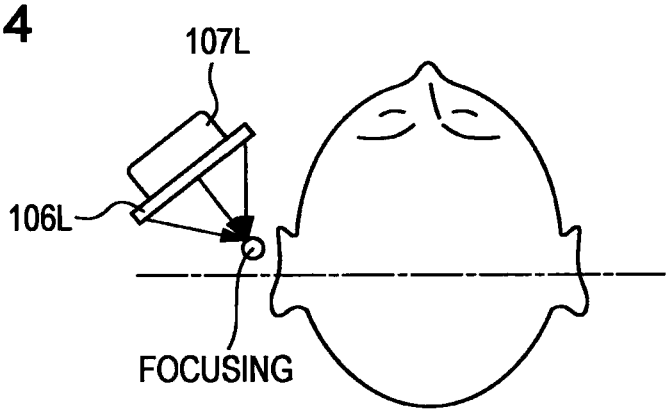
FIG. 14 is a diagram illustrating that focusing of sound which is formed by a sound signal output from each speaker of a sound reproduction unit (speaker array) can be positioned between the speaker array and an entrance of an external auditory canal.

The focusing of the sound formed by the sound signal output from each speaker of the sound reproduction units (speaker arrays) 106L and 106R can be positioned between the speaker array and the entrance of the external auditory canal as shown in FIG. 14, and the virtual sound source is synthesized at the position.

Since the sound source is not a substantial sound source in this case, the speaker array as the sound generating unit is not provided in the vicinity of the ear auricle, and there is no reflection in the speaker array, it is possible to obtain a stable property. Although reflection occurs in the ear auricle of the headphone user (listener) in this case, the reflection is the same as that of the sound which the headphone user usually listens to. That is, since the sound transmitted from the entrance of the external auditory canal to the drum membrane includes a property of the ear auricle of the headphone user (listener), it is possible to improve the front orientation of the sound image.

(3) "Position Behind Speaker Array"

Figure 15:
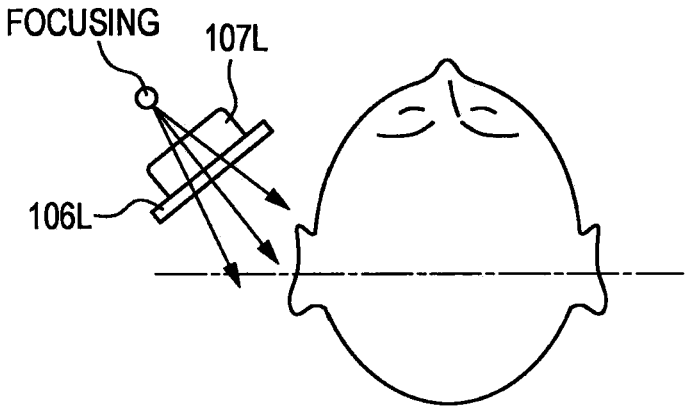
FIG. 15 is a diagram illustrating that focusing of sound which is formed by a sound signal output from each speaker of a sound reproduction unit (speaker array) can be positioned behind the speaker array.

The focusing of the sound formed by the sound signal output from each speaker of the sound reproduction units (speaker arrays) 106L and 106R can be positioned behind the speaker array as shown in FIG. 15, and the virtual sound source with no substance is synthesized at this position. Since the virtual sound source is already synthesized away from the headphone user (listener) in this case, it is possible to enhance a sense of distance in the sound image orientation.

Figure 16:
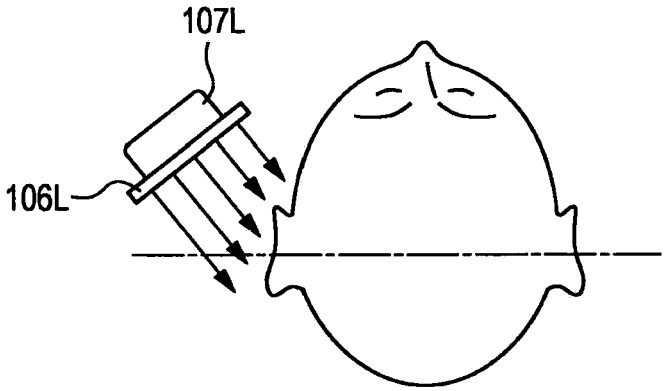
FIG. 16 is a diagram illustrating a case in which sound formed by a sound signal output from each speaker of a sound reproduction unit (speaker array) is a planar wave.

Next, description will be given of a case in which the sound formed by the sound signal output from each speaker of the sound reproduction units (speaker arrays) 106L and 106R is allowed to be a planar wave as shown in FIG. 16. A sound wave from a real sound source at a position away from the headphone user (listener), for example, a speaker located in front of the headphone listener to both ears of the listener becomes close to a planar wave in the vicinity of the ear auricle. In addition, a sound wave in a low-frequency band, namely a sound wave with a long wavelength is generated from the speaker placed in front of the headphone user in a form which is close to that of a planar wave.

It is possible to approximate the states of reflection and refraction in the ear auricle of the headphone user to a state in the reproduction by the speaker placed away from the headphone user by allowing the sound formed by the sound signal output from each speaker of the sound reproduction units (speaker arrays) 106L and 106R to be a planar wave as described above. Therefore, a natural sound image orientation can be achieved. In addition, reproducibility of sound in a low-frequency band is enhanced.

It is possible to satisfactorily reproduce two-channel sound signals in the stereo headphone system 10 shown in FIG. 1 as described above. That is, the sound formed by the sound signal output from each speaker of the sound reproduction units (speaker arrays) 106L and 106R can be focused at a predetermined position, and a virtual sound source can be synthesized at the predetermined position. As described above, it is possible to achieve various effects in accordance with the focus position by positioning the focusing at the entrance of the external auditory canal of the headphone user, between the speaker array and the entrance of the external auditory canal, behind the speaker array, and the like. In addition, it is possible to allow the sound formed by the sound signal output from each speaker of the sound reproduction units (speaker arrays) 106L and 106R to be a planar wave and thereby to achieve effects such as an effect that a natural sound image orientation becomes possible as described above.

2. Second Embodiment

Configuration Example of Stereo Headphone System

Figure 17:
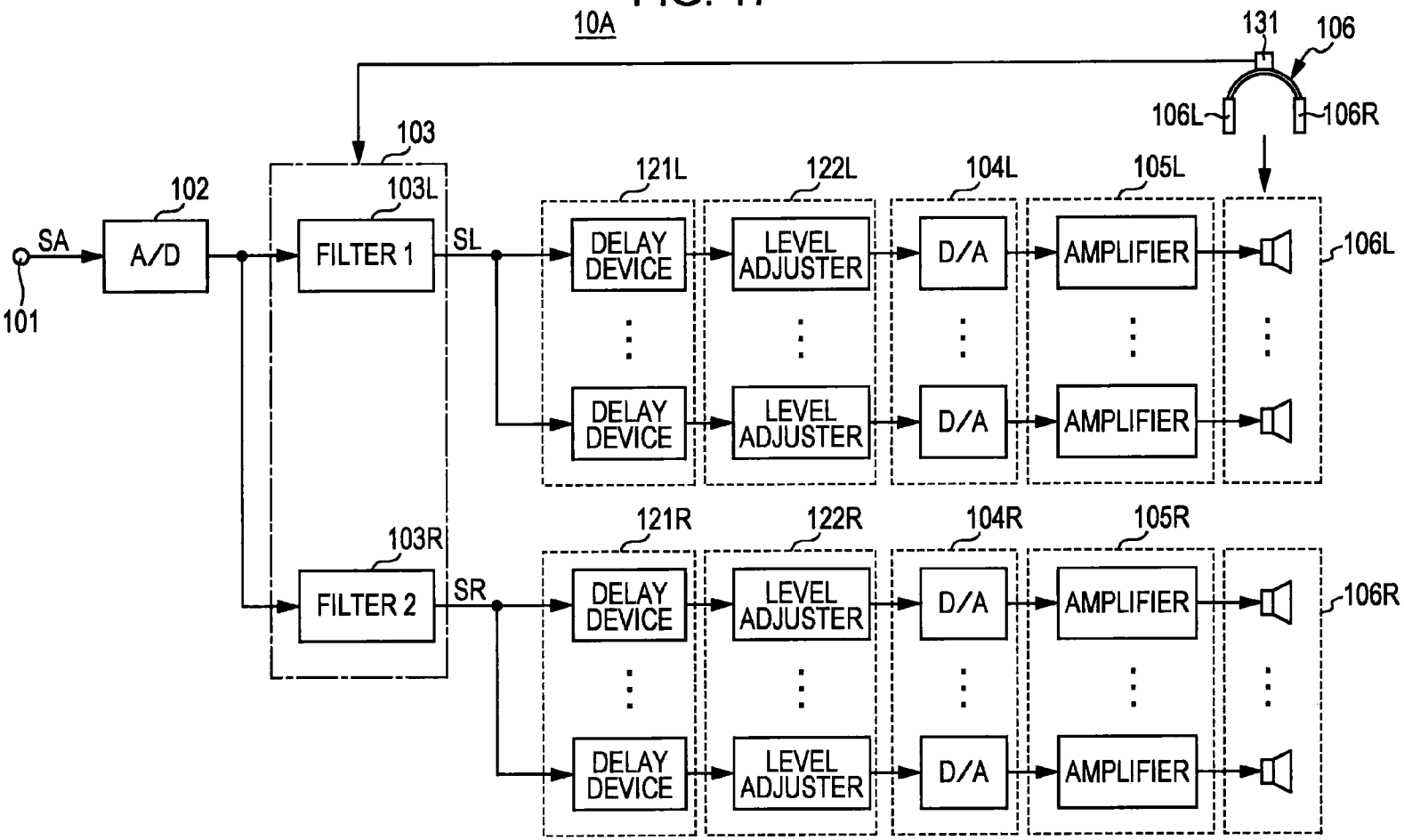
FIG. 17 is a block diagram showing a configuration example of a stereo headphone system according to a second embodiment of the present disclosure.

FIG. 17 shows a configuration example of a stereo headphone system 10A according to a second embodiment. In FIG. 17, the same reference numerals are given to components corresponding to those in FIGS. 1 and 11, and the detailed description thereof will be appropriately omitted.

The stereo headphone system 10A is provided with the input terminal 101, the A/D converter 102, the signal processing unit 103, the D/A converters 104L and 104R, the amplifiers 105L and 105R, and the headphone unit 106. In addition, the stereo headphone system 10A is provided with the delay devices 121L and 121R and the level adjusters 122L and 122R between the signal processing unit 103 (filters 103L and 103R) and the D/A converters 104L and 104R.

Figure 18:
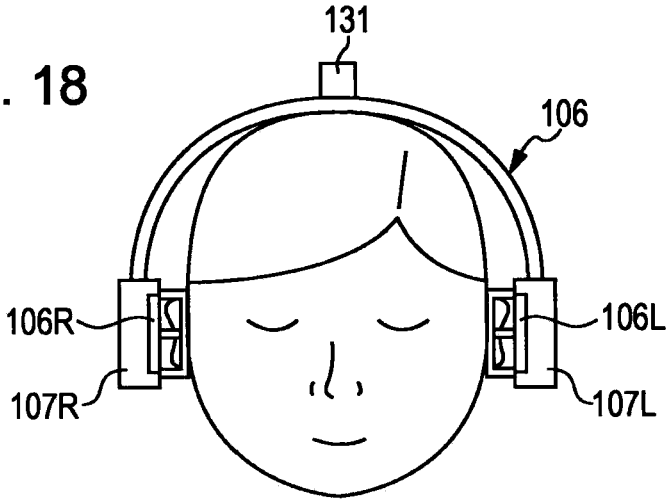
FIG. 18 is a diagram showing a state in which a headphone user (listener) wears a headphone unit provided with a sensor configuring a head motion detecting unit.

In the stereo headphone system 10A, the headphone unit 106 is provided with a sensor 131 which detects a state of the head of the headphone user (listener). The sensor 131 is an angular velocity sensor such as a gyro sensor, a gravity acceleration sensor, a magnetic sensor, or the like. The sensor 131 configures a head motion detecting unit. FIG. 18 shows a state in which the headphone user (listener) wears the headphone unit 106 provided with the sensor 131.

Since the sound reproduction unit of the headphone is generally fixed to the head of the headphone user (listener), the sound reproduction unit moves in conjunction with the motion of the head. The stereo headphone system 10A shown in FIG. 17 corrects a sound image orientation position by the headphone reproduction so as not to be deviated even when the state of the head is varied as described above. The stereo headphone system 10A updates coefficients of the filters 103L and 103R in the signal processing unit 103, namely transmission properties thereof in accordance with the output signal of the sensor 131 and operates such that the sound image orientation position is fixed.

Figure 19A:
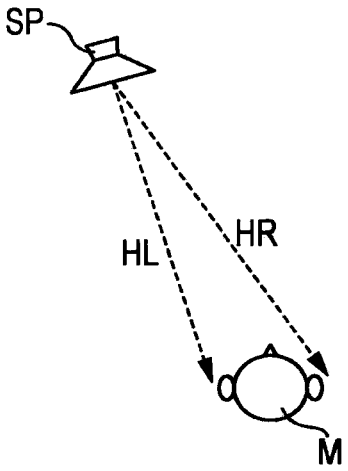
FIGS. 19A and 19B are diagrams showing that transmission properties HL and HR when a headphone user faces front are different from transmission properties HLθ and HRθ when the headphone user faces a direction rotated from the front by an angle θ.
Figure 19B:
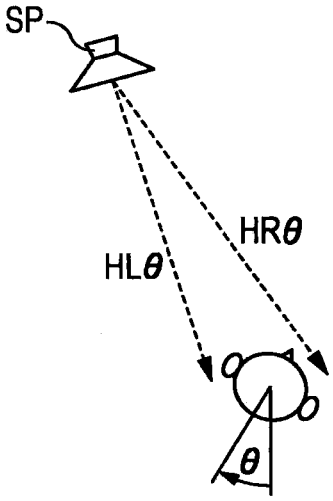

For example, it is assumed that HL and HR represent transmission properties when the headphone user (listener) faces front as shown in FIG. 19A and HLθ and HRθ represent transmission properties when the headphone user (listener) faces a direction rotated from the front by an angle θ as shown in FIG. 19B. The coefficients set in the filters 103L and 103R change from HL to HLθ in the filter 103L and from HR to HRθ in the filter 103R in accordance with the angle θ of the head.

As described above, it is possible to fix the sound image orientation position by updating the coefficients of the filters 103L and 103R, namely the transmission properties in accordance with the motion of the head of the headphone user (listener) even when the state of the head is varied. For example, when a sound signal accompanying with a moving image is listened to, a moving image position is deviated from the sound image position in accordance with the motion of the head according to a headphone in the related art.

According to the stereo headphone system 10A shown in FIG. 17A, however, it is possible to change the properties of the filters 103L and 103R in accordance with the motion of the head of the headphone user (listener) and thereby to avoid deviation of the sound image position with respect to the moving image position when the state of the head is changed. That is, it is possible to allow a direction of the moving image to be coincident with a direction of the sound image and thereby to realize moving image and sound reproduction with high quality. By allowing the sound image orientation direction to be equivalent to how the sound sounds when the headphone user does not wear the headphone as described above, it is also possible to achieve an effect that a sense of a front orientation of a sound image is enhanced, which is difficult in the headphone reproduction.

3. Third Embodiment

Configuration Example of Stereo Headphone System

Figure 20:
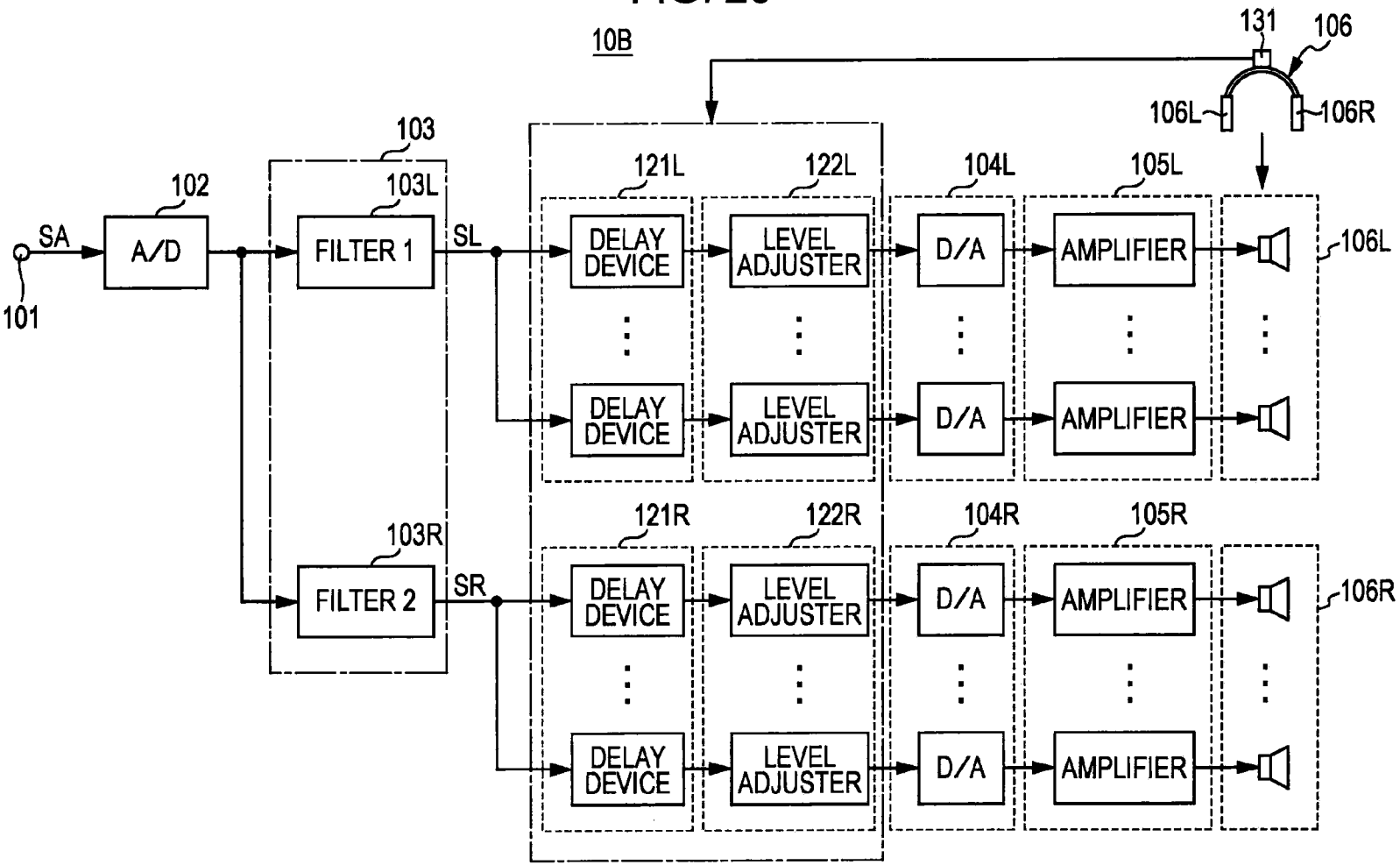
FIG. 20 is a block diagram showing a configuration example of a stereo headphone system according to a third embodiment of the present disclosure.

FIG. 20 shows a configuration example of a stereo headphone system 10B according to a third embodiment. In FIG. 20, the same reference numerals are given to components corresponding to those in FIGS. 1, 11, and 17, and the detailed description thereof will be appropriately omitted.

The stereo headphone system 10B is provided with the input terminal 101, the A/D converter 102, the signal processing unit 103, the D/A converters 104L and 104R, the amplifiers 105L and 105R, and the headphone unit 106. In addition, the stereo headphone system 10A is provided with the delay devices 121L and 121R and the level adjusters 122L and 122R between the signal processing unit 103 (filters 103L and 103R) and the D/A converters 104L and 104R.

In the stereo headphone system 10B, the headphone unit 106 is provided with the sensor 131 which detects a state of a head of the headphone user (listener) in the same manner as in the aforementioned stereo headphone system 10A. The stereo headphone system 10B corrects the sound image orientation position by the headphone reproduction so as not to be deviated even when the state of the head is varied in the same manner as in the aforementioned headphone system 10A.

The aforementioned stereo headphone system 10A updates coefficients in the filters 103L and 103R of the signal processing unit 103, namely transmission properties thereof in accordance with the motion of the head in accordance with the output signal of the sensor 131. However, the stereo headphone system 10B updates a position of a virtual sound source synthesized by the sound reproduction units (speaker arrays) 106L and 106R in accordance with the output signal of the sensor 131, namely the motion of the head. That is, the stereo headphone system 10B controls delay time and/or a level of the sound signal output to each speaker of the speaker array in accordance with the output signal of the sensor 131, namely the motion of the head, and moves the position of the virtual sound source. In such a case, a delay amount and a level adjustment amount in the delay devices 121L and 121R and the level adjusters 122L and 122R are controlled based on the output signal of the sensor 131.

Figure 21C:
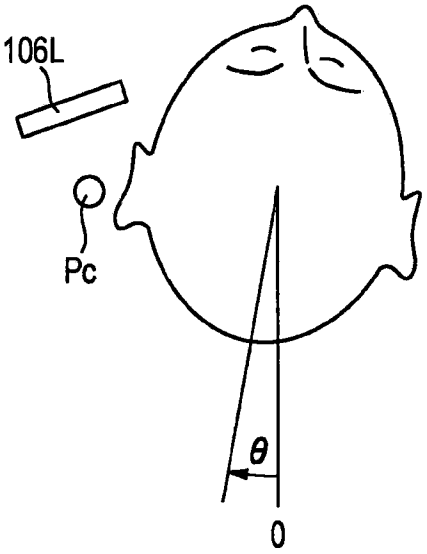
FIGS. 21A to 21C are diagrams showing an example in which a position of a virtual sound source synthesized by a sound reproduction unit (speaker array) in accordance with a motion of a head is updated.
Figure 21A:
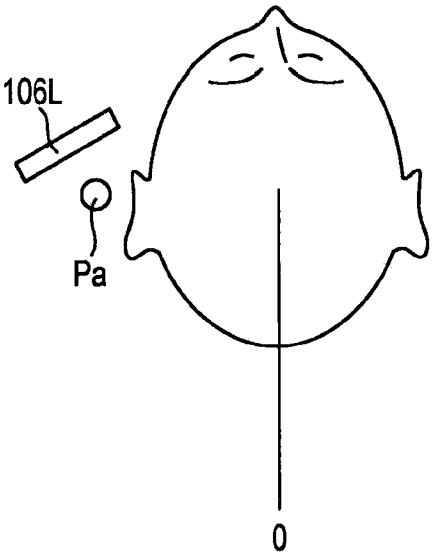
Figure 21B:
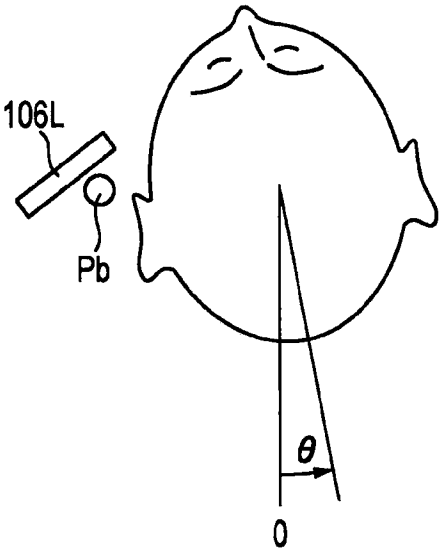

For example, when the headphone user (listener) faces a front direction as shown in FIG. 21A, the virtual sound source is synthesized at a position Pa. Next, when the headphone user (listener) rotates his/her head to a left direction by an angle θ and faces the left direction as shown in FIG. 21B, the virtual sound source is synthesized at a position Pb which is far from the ear auricles. On the other hand, when the headphone user (listener) rotates his/her head to a right direction by the angle θ and faces the right direction as shown in FIG. 21C, the virtual sound source is synthesized at a position Pc which is close to the ear auricles.

Figure 22:
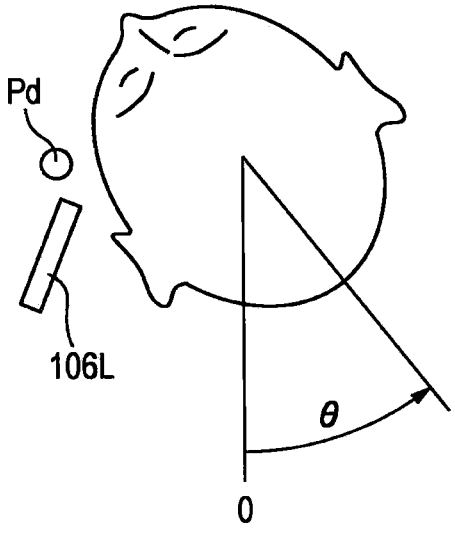
FIG. 22 is a diagram illustrating that a position of a virtual sound source may be behind a sound reproduction unit (speaker array) depending on an angle θ of a head motion of a headphone user (listener).

In FIGS. 21A to 21C, the virtual sound source is positioned in front of the sound reproduction unit (speaker array 106L). However, the virtual sound source may be at the back position Pb behind the sound reproduction unit (speaker array) 106L as shown in FIG. 22 depending on the angle θ of the head motion of the headphone user (listener).

As described above, the virtual sound source position is controlled in accordance with the motion of the head according to the stereo headphone system 10B shown in FIG. 20. Therefore, it is possible to fix the sound image orientation position even when the state of the head is varied in the same manner as in the stereo headphone system 10A shown in FIG. 17 and thereby to achieve the same effect. In addition, since control of the virtual sound source corresponds to control of the sound image by wave surface synthesis according to the stereo headphone system 10B, it is possible to realize sound image control which is less influenced by the property of the ear auricles of the headphone user (listener).

The present disclosure contains subject matter related to that disclosed in Japanese Priority Patent Application JP 2011-040964 filed in the Japan Patent Office on Feb. 25, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A headphone apparatus comprising:

sound reproduction units which respectively reproduce sound signals and are arranged so as to be separated from ear auricles of a headphone user; and a head motion detecting unit which detects a state of a head of the headphone user, wherein each of the sound reproduction units is configured by a speaker array including a plurality of speakers, and wherein an orientation of a sound image formed by the reproduced sound signals is controlled, based on the detected state of the head of the headphone user in relation to a location of an object or a visual content that is associated with the reproduced sound signals and that is being viewed by the headphone user.

2. The headphone apparatus according to claim 1, wherein each of the sound reproduction units is arranged in front of the ear auricle of the headphone user.

3. The headphone apparatus according to claim 2, wherein a sound generating surface of the speaker array is arranged so as to have a predetermined angle with respect to a surface facing the ear auricle of the headphone user.

4. The headphone apparatus according to claim 1, wherein each of the sound reproduction units is arranged behind the ear auricle of the headphone user.

5. The headphone apparatus according to claim 4, wherein a sound generating surface of the speaker array is arranged so as to have a predetermined angle with respect to a surface facing the ear auricle of the headphone user.

6. The headphone apparatus according to claim 1, wherein a sound signal output from each speaker of the speaker array is configured such that sound formed by the sound signal is focused at a predetermined position.

7. The headphone apparatus according to claim 6, wherein the focusing is performed by adding a time difference and/or a level difference to the sound signal output from each speaker of the speaker array.

8. The headphone apparatus according to claim 7, wherein a position of the focusing is changed based on the detected state of the head of the headphone user in relation to the location of the object or the visual content that is associated with the output sound signals and that is being viewed by the headphone user.

9. The headphone apparatus according to claim 6, wherein the focusing is performed by arranging each speaker of the speaker array on a curve surface so as to surround a respective ear auricle of the headphone user.

10. The headphone apparatus according to claim 6, wherein the focusing is positioned at an entrance of an external auditory canal of the headphone user.

11. The headphone apparatus according to claim 6, wherein the focusing is positioned between the speaker array and an entrance of an external auditory canal of the headphone user.

12. The headphone apparatus according to claim 6, wherein the focusing is positioned behind the speaker array.

13. A sound reproduction method for a headphone apparatus comprising:

configuring each sound reproduction unit of a stereo headphone apparatus with a speaker array including a plurality of speakers and arranging each sound reproduction unit so as to be separated from an ear auricle of a headphone user;

detecting a state of a head of the headphone user;

reproducing sound signals via the speaker array; and controlling an orientation of a sound image formed by the reproduced sound signals, based on the detected state of the head of the headphone user in relation to a location of an object or a visual content that is associated with the reproduced sound signals and that is being viewed by the headphone user.

* * * * *